US005531267A

United States Patent [19]

Ahmed et al.

[11] Patent Number: 5,531,267

[45] Date of Patent: Jul. 2, 1996

[54] REFRIGERATION CENTRIFUGAL BLOWER SYSTEM

[75] Inventors: Sohail Ahmed; Kevin M. May, both of St. Louis County, Mo.

[73] Assignee: Emerson Electric Co., St. Louis, Mo.

[21] Appl. No.: 295,209

[22] Filed: Aug. 24, 1994

[51] Int. Cl.[6] ..... F28F 13/06

[52] U.S. Cl. ..... 165/124; 62/426; 415/208.1; 415/203

[58] Field of Search ..... 165/122, 124; 62/515, 426, 413; 415/178, 203, 208.1, 211.2

[56] References Cited

U.S. PATENT DOCUMENTS

| | | | |
|---|---|---|---|
| 2,633,070 | 3/1953 | Gillham | 165/124 X |
| 4,958,504 | 9/1990 | Schibawa et al. | 165/122 X |

FOREIGN PATENT DOCUMENTS

| | | | |
|---|---|---|---|
| 335831 | 3/1959 | Switzerland | 165/124 |

*Primary Examiner*—John C. Fox

*Attorney, Agent, or Firm*—Polster, Lieder, Woodruff & Lucchesi

[57] ABSTRACT

In a refrigeration system in which coils are mounted in a coil passage, a fan system is provided by which air is caused to pass over the coils. The fan system includes a housing communicating with a coil passage. The housing has an intake and an outlet each with a mouth, the mouths of the intake and outlet being oriented substantially 180° from on another. A centrifugal scroll caged blower is mounted in the housing and an electric motor is connected to rotate the blower. Baffles are provided within the housing for directing air in separate paths through the housing intake to an inlet of the blower and from the blower through the housing outlet, the flow of the air through the housing mouths lying in substantially parallel planes.

6 Claims, 3 Drawing Sheets

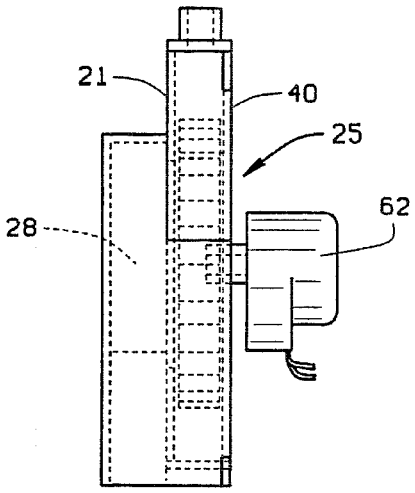
FIG. 7
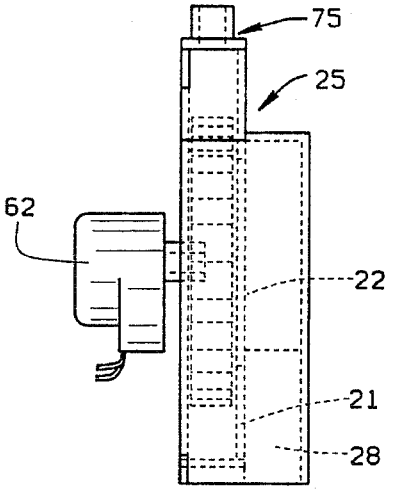
FIG. 8
FIG. 9
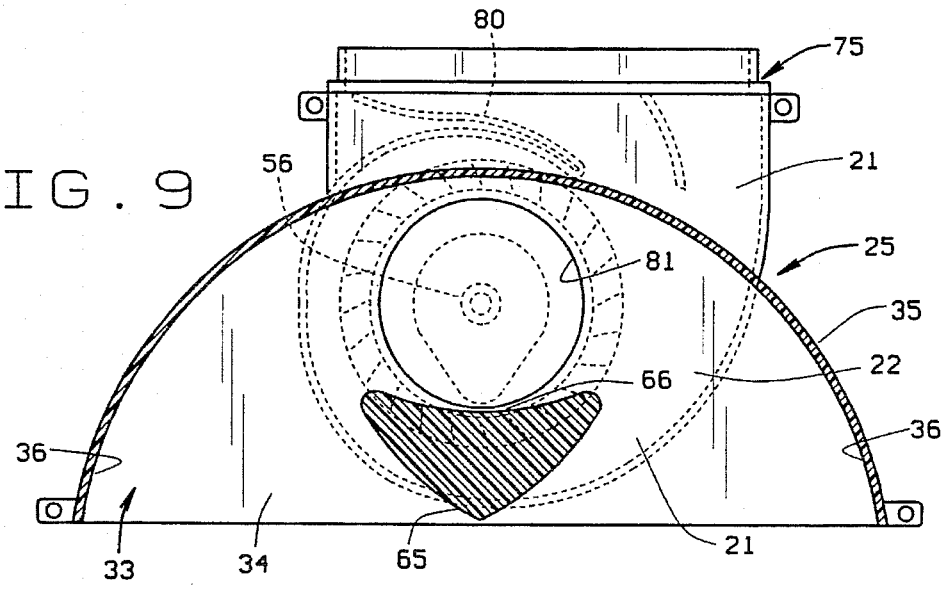
FIG. 10
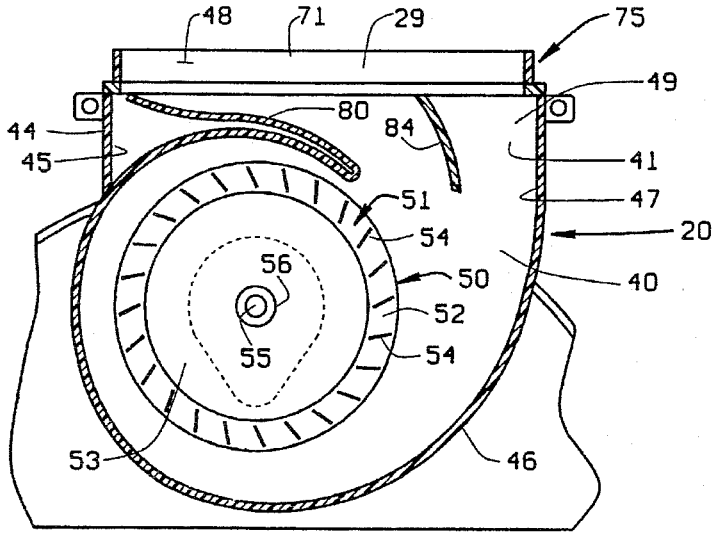

REFRIGERATION CENTRIFUGAL BLOWER SYSTEM

BACKGROUND OF THE INVENTION

Refrigeration systems, whether they be household or commercial refrigerators or freezers, or air conditioners or dehumidifiers, and whether they be absorption type or compression type systems, use two sets of coils, condenser coils and evaporator coils. The condenser coils require cooling, which in modern refrigeration systems, is provided by fan-induced movement of air over them. In modern refrigeration systems, cold air from the evaporator coils is circulated by means of a fan. In either case, space considerations are important. The coils are generally located in a coil passage defined by spaced front and back walls, generally parallel with one another, defining a passage that is wide relative to its depth, e.g. 16" wide and less than 3" deep. Axial flow fans have been used, but they occupy more space than is desirable, do not provide for a straight flow-through pattern, and do not necessarily provide uniform distribution over the coils.

One of the objects of this invention is to provide a blower system that occupies a minimum amount of space, while providing a relatively even flow of air across the coils, and improved efficiency as compared with systems known heretofore.

Other objects will become apparent to those skilled in the art in the light of the following description and accompanying drawing.

SUMMARY OF THE INVENTION

In accordance with this invention, generally stated, in a refrigeration system in which coils are mounted in a coil passage defined by front and back walls, the walls being spaced from one another a short distance relative to their width, a blower system is provided by which air is caused to pass over the coils. The blower system includes a housing communicating with the coil passage, the housing having an intake and a outlet each with a mouth. The mouths of the intake and outlet are oriented substantially 180° from one another. A centrifugal scroll caged blower is mounted in the housing, driven by an electric motor. Baffles are provided for directing air through the housing intake to an inlet of the blower and from the blower through the housing outlet, the flow of air through the mouths lying in substantially parallel planes. Particularly when the blower system is associated with evaporator coils, the intake mouth of the blower housing communicates directly with the coil passage. In particular, the intake passage of the housing is defined by an inner surface of a front intake wall and an outside surface of a blower casing wall that is substantially parallel to the front intake wall and spaced therefrom. Intake side walls connect the blower housing intake front and back walls. The outlet mouth is defined by surfaces generally parallel with the walls defining the intake passage. A scroll wall of the scroll caged blower is supported by and mounted in the blower housing between the intake and outlet, a scroll wall extends around a blower wheel from a point on the outlet side of the blower wheel, around the diametrically opposite side of the wheel, to a point at which it forms a boundary of the outlet mouth. The blower housing is substantially centered widthwise of the coil passage. A heart-shaped intake baffle is symmetrically arranged with respect to the blower inlet, spanning between the intake front wall and the blower casing wall, with a center of a concave arc along an edge of the blower inlet and an apex toward the mouth of the intake. Baffles on the outlet side include an outlet guide wing and at least one divider wall, the outlet guide wing having a free edge adjacent a blower wheel and the guide wing extending away from the blower wheel in an arc concave with respect to the blower wheel and approaching the outlet mouth in an arc convex with respect to the blower wheel, and the divider wall being concave with respect to the blower wheel and spaced a substantial distance from the guide wing to define with the guide wing and with a volute side wall two exhaust air passages.

The blower system delivers at least at least 40 cfm of air at 0.23 inches of static pressure.

Preferably the motor driving the blower is a brushless permanent magnet motor, which can be of the type described in co-pending application Ser. No. 08/237,782.

IN THE DRAWINGS

FIG. 7 is an end view, viewed from left to right of FIG. 4;

FIG. 8 is an end view, viewed from left to right of FIG. 3;

FIG. 9 is a sectional view taken along the line 9—9 of FIG. 6; and

FIG. 10 is a sectional view taken along the line 10—10 of FIG. 6.

DESCRIPTION OF THE PREFERRED EMBODIMENT

Figure 2:
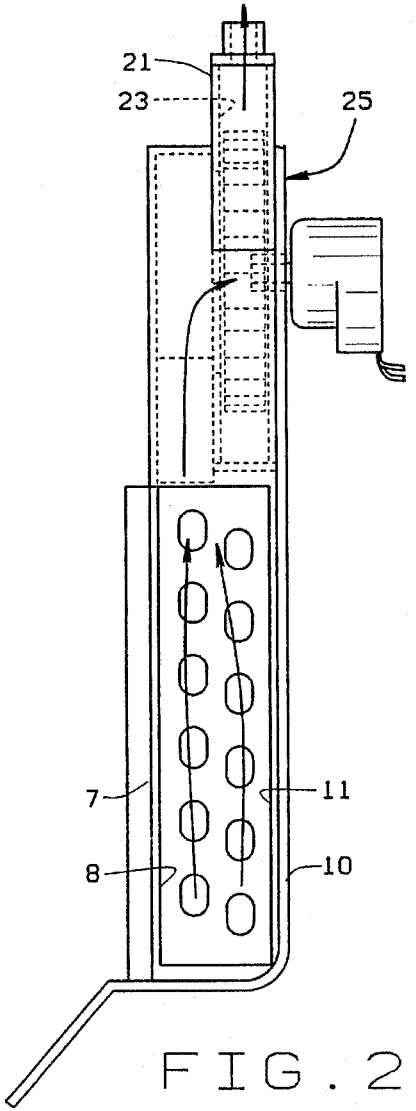
FIG. 2 is a view in side elevation of FIG. 1, with evaporator coils shown somewhat schematically.
Figure 1:
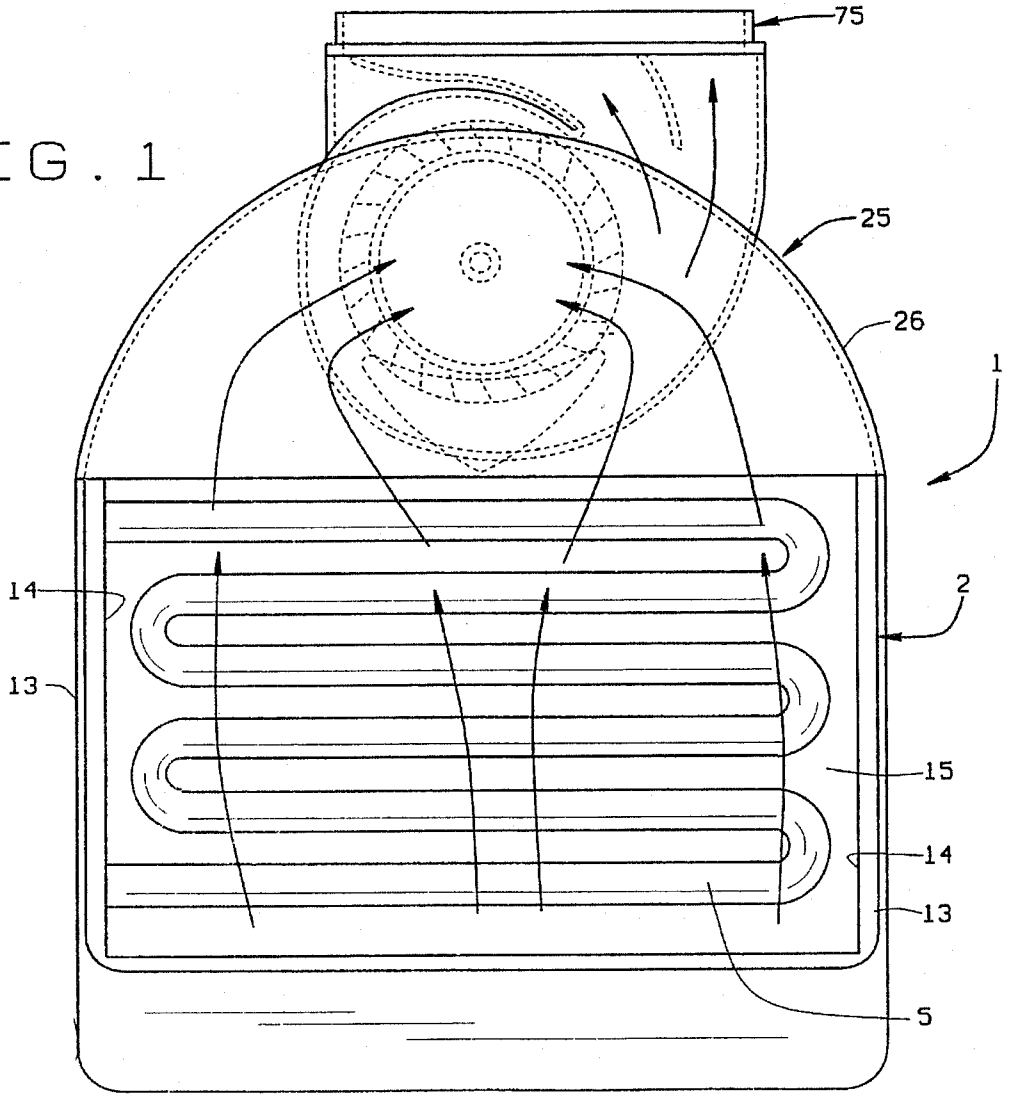
FIG. 1 is a view in front elevation of an evaporator in a refrigerator.
Figure 3:
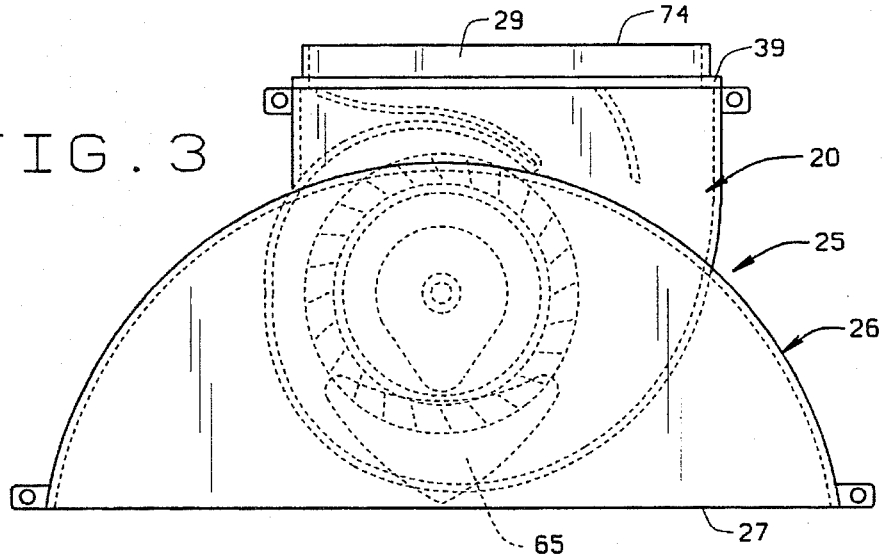
FIG. 3 is a view in front elevation of a centrifugal blower assembly of this invention.
Figure 4:
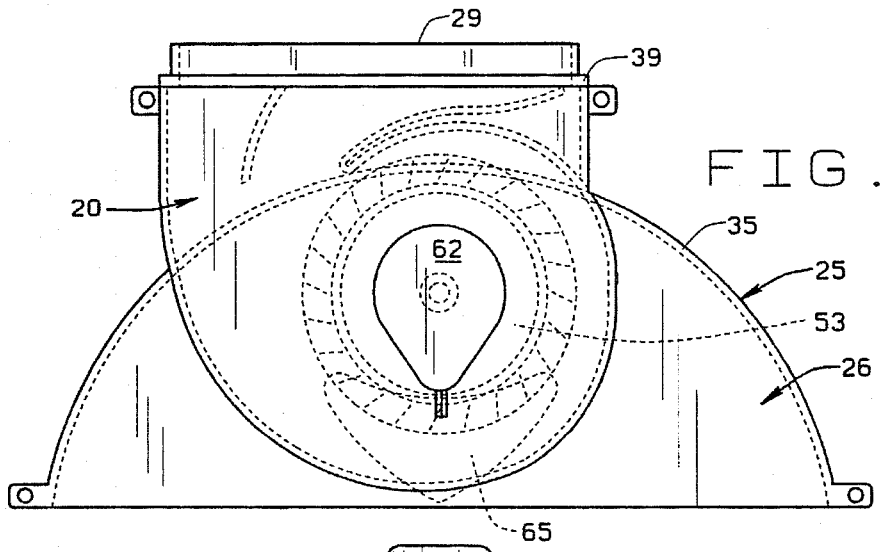
FIG. 4 is a view in rear elevation of the assembly of FIG. 3.
Figure 5:
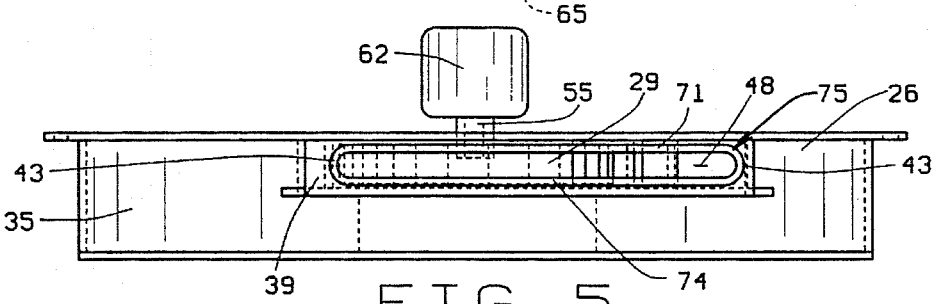
FIG. 5 is a top plan view.
Figure 6:
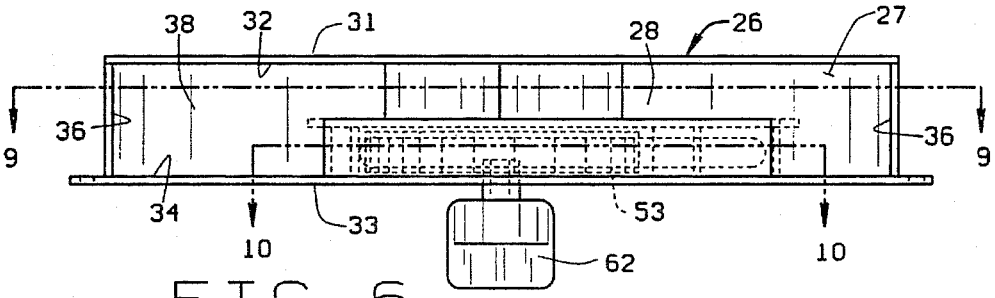
FIG. 6 is a bottom plan view.

Referring now to the drawing for one illustrative embodiment of this invention, reference numeral 1 indicates a refrigerant system with an evaporator 2. Evaporator coils 5 are arranged in a coil passage 15 defined by an inner surface 8 of a front wall 7 and an inner surface 11 of a back wall 10, and inner surfaces 14 of side walls 13.

A blower assembly 25 is, in this illustrative embodiment, mounted on the upper end of the coil passage 15. The assembly includes a housing 26 which has an intake 27 and an outlet 29. The intake 27 has an intake mouth 38 defined by an inner surface 32 of an intake front wall 31, which can be an extension of the front wall 7 of the coil passage 15, an inner surface 34 of an intake back wall 33, which can be an extension of the back wall 10 of the coil passage 15, and inner surfaces 36 of two legs of an arched wall 35. An intake passage 28 is defined by the inner surface 32 of the front wall 31, an outer surface 22 of a front wall 21 of a blower casing 20, and an inner surface of the central section of the arched wall 35. As can be observed, the outer surface 22 of the blower casing front wall is spaced from and parallel to the inner surface 32 of the front wall 31. The front wall 21 of the blower casing has a relatively large circular opening in it forming a blower inlet 81.

In the illustrative embodiment, the blower casing 20 includes besides the blower casing front wall 21, a blower casing back wall 40 and a scroll or volute wall 46. A centrifugal blower assembly 50 is made up of a blower wheel 51 with blades 54 mounted at one end in a ring 52 and at another end in a disc 53, a motor shaft 55 mounted in a hub 56 to which the disc 53 is secured, a motor bearing 58 in which the shaft 55 is journaled, and a motor 62, in this embodiment, a brushless permanent magnet motor. The motor 62 is mounted on and extends outwardly from the blower casing back wall 40, the shaft 55 extending through an opening in the back wall. The shaft 55 and wheel 51 are concentric with the inlet opening 81.

In the embodiment shown, the outlet 29 has an outlet mouth 48 and an outlet passage 49. The outlet passage 49 is defined by an inner surface 41 of the back wall 40 of the blower casing, which also constitutes an outlet back wall, an inner surface 23 of the blower casing front wall 21 which also constitutes an outlet front wall, an inner surface 45 of a side wall 44, and an inner surface 47 of the volute wall 46. The outlet mouth 48 is defined by inner surfaces of an outlet fitting 75 having a back wall 71, a front wall 74, parallel to and spaced from the back wall, and curved end walls 43 joining the front and back walls. The fitting has an outwardly extending flange 39 that mounts on flat surfaces of the walls defining the outlet passage 49. The outlet fitting 75 is connected to a wide duct, not here shown.

A guide wing 80 is doubly curved, with an outer end part that is convex relative to the wheel 51, ending at the upper edge of the inner surface 45 of the side wall 44, and an inner end part that is concave relative to the wheel 51, ending immediately above and against an upper surface of an inner end of the volute wall 46. The guide wing 80 extends entirely across the passage 49.

The volute wall 46 extends and bridges between the blower casing front wall 21 and the blower casing back wall 40. From its inner end, which is close to the blower blades 54, the volute wall is removed progressively farther from the blower wheel to a point near its upper, outer end at which the volute side wall becomes substantially parallel to the side wall 44.

A divider wall 84, concave with respect to the wheel 51, extends between the blower front an back walls, has an upper end that ends at the upper surface of the walls defining the outlet passage 49, and is spaced inwardly from the upper end of the volute wall 46 to define another outlet channel.

An important element of the present invention is an intake air divider 65. The intake divider 65 is in the inlet passage 28, extending transversely between the inner surface 32 of the housing front wall 31 and the outer surface 22 of the blower casing front wall 21. In the embodiment shown, the divider 65 is heart shaped in front elevation with a concave upper part 66, a central portion of an outer surface of which is coincident with a lower edge of the inlet opening 81 in the blower casing front wall 21, and convex side walls meeting in a line at their lower ends.

The divider 65 provides a desirable distribution of air flowing over the coils 5.

Merely by way of example, if the front wall 7 and back wall 10 of the coil passage are 16" wide and 10" high, and spaced 2.5" outside to outside, the total length of the blower housing is 16", and the spacing of the front wall 31 from the intake back wall 33 is also 2.5" outside to outside. The blower wheel is 3.82" in diameter, and the inlet opening 81, 3.11". The total height of the back wall of the blower housing is 7.5". If ⅛" stock is used for the walls, the width of the open intake mouth is 2.6" and the width of the open outlet mouth, 1.0". The intake passage 28 is 1.0" wide, i.e., the outer surface of the blower casing and the inner surface of the intake front wall are 1.6" apart. The air divider 65 is 4.0" wide and 2.325" high at center. The guide wing 80 is 4.075" long (curve length), and its inner end is spaced 0.2" from the outside surface of the blower wheel 51. The divider 84 is 1.5" long, is spaced 2.2" from the upper end of the volute wall 46 at the upper end of the divider, and 1.7" from the volute wall at the lower end of the divider. The distance between the side wall 44 and the upper end of the volute wall 46 is 7.21".

The outlet mouth opening is effectively, 7.0" by 1.0" or 7.0 square inches. The blower provides 0.23 inches Wg. of static pressure head at 40 cubic feet per minute, at 1900 RPM, using less than 8 watts of power. The blower wheel of this example is of a type sold commercially as Beckett Air Blower Wheel Cat.#F120-255.

The dimensions given above are illustrative of one operative assembly of this invention. The dimensions of the assembly and of its components, the configuration of the blower wheel blades, and the type, speed and power of the motor can be varied, depending upon the application and upon the requirements of the use to which the assembly is to be put.

Typical performance figures for the assembly of this invention are set out in the following tables, where the "cut-off clearance" is the distance, measured radially from the axis of rotation of the blower wheel, from the outside of the blower wheel to the surface of the guide wing nearest the blower wheel.

TABLE I

REFRIGERATION CENTRIFUGAL BLOWER
AIR FLOW PERFORMANCE AT 24 DC VOLTS

| Air Flow Rate | Static Pressure | RPM | Watts |
|---|---|---|---|
| 5.21 | 0.70 | 3167 | 11.85 |
| 14.10 | 0.76 | 3005 | 14.26 |
| 20.79 | 0.69 | 2982 | 14.76 |
| 29.58 | 0.60 | 2929 | 15.46 |
| 37.95 | 0.47 | 2915 | 15.93 |
| 45.79 | 0.37 | 2864 | 16.63 |
| 54.45 | 0.25 | 2789 | 17.65 |
| 62.88 | 0.12 | 2733 | 18.73 |
| 72.43 | 0.00 | 2670 | 19.77 |

Note: Cut-off Clearance = 0.125 in.

TABLE II

REFRIGERATION CENTRIFUGAL BLOWER
AIR PLOW PERFORMANCE AT 21 DC VOLTS

| Air Flow Rate | Static Pressure | RPM | Watts |
|---|---|---|---|
| 7.39 | 0.56 | 2836 | 8.32 |
| 7.50 | 0.55 | 2841 | 8.32 |
| 17.68 | 0.56 | 2693 | 10.26 |
| 25.16 | 0.49 | 2661 | 10.71 |
| 32.76 | 0.36 | 2662 | 10.87 |
| 39.32 | 0.28 | 2603 | 11.41 |
| 46.56 | 0.19 | 2549 | 12.23 |
| 53.94 | 0.10 | 2496 | 13.12 |
| 61.91 | 0.00 | 2439 | 13.85 |

Note: Cut-off Clearance = 0.125 in.

TABLE III

| REFRIGERATION CENTRIFUGAL BLOWER AIR FLOW PERFORMANCE AT 18 DC VOLTS | | | |
|---|---|---|---|
| Air Flow Rate | Static Pressure | RPM | Watts |
| 5.19 | 0.42 | 2148 | 6.12 |
| 11.83 | 0.46 | 2193 | 7.43 |
| 16.85 | 0.42 | 2068 | 7.65 |
| 23.40 | 0.36 | 2045 | 7.80 |
| 30.49 | 0.29 | 1793 | 8.11 |
| 38.24 | 0.19 | 1810 | 8.73 |
| 43.98 | 0.14 | 1818 | 9.18 |
| 50.28 | 0.07 | 1831 | 9.61 |
| 57.72 | 0.00 | 1330 | 10.19 |

Note: Cut-off Clearance = 0.375 in.

TABLE IV

| REFRIGERATION CENTRIFUGAL BLOWER AIR FLOW PERFORMANCE KANCE AT 15 DC VOLTS | | | |
|---|---|---|---|
| Air Flow Rate | Static Pressure | RPM | Watts |
| 7.38 | 0.33 | 2117 | 4.23 |
| 17.64 | 0.36 | 1995 | 5.49 |
| 19.95 | 0.35 | 1977 | 5.75 |
| 27.86 | 0.31 | 1931 | 6.28 |
| 32.24 | 0.28 | 1902 | 6.67 |
| 41.42 | 0.21 | 1846 | 7.26 |
| 48.94 | 0.14 | 1797 | 7.86 |
| 56.24 | 0.06 | 1755 | 8.39 |
| 64.35 | 0.00 | 1720 | 8.91 |

Note: Cut-off Clearance = 0.375 in.

Centrifugal blowers are well known, but conventional centrifugal blower assemblies cannot meet the performance standards of the blower assembly of this invention. The construction of the blower assembly of this invention provides efficiencies at lower speeds that have not been achieved heretofore, provides better air flow, improved coil efficiency on account of the relatively even distribution of air flow across the coils, among other things, and quieter operation, thanks to the lower speeds of rotation required.

Numerous variations in the construction of the device of this invention, within the scope of the appended claims, will occur to those skilled in the art in the light of the foregoing disclosure. The dimensions can be varied, depending upon the size of the coil passage and the flow of air required. The blower assembly can be used in conjunction with condenser coils as well as with evaporator coils. The shape of the guide wing and the placement and shape of the outlet divider wall can be varied to direct air differently. As has been indicated in the tables, the distance of the guide wing from the blower wheel can be varied. The shape of the inlet divider can be varied, and its size as well, to accommodate different requirements and dimensions of the coils, although the configuration of the inlet divider should not depart significantly from the shape shown. Although such an arrangement is not ordinarily used, the motor can be mounted, on a spider in the inlet opening, in the inlet side of the blower wheel, to nest inside the blower wheel. This reduces the effective size of the inlet, but it provides a more compact arrangement. These are merely illustrative.

We claim:

1. In a refrigeration system in which coils are mounted in a coil passage defined by front and back walls, said walls being spaced from one another a short distance relative to their width, a blower system by which air is caused to pass over said coils comprising a housing communicating with said coil passage, said housing having an intake and an outlet, each with an axially elongated mouth the mouths of said intake and outlet being oriented substantially 180° from one another, said inlet mouth communicating with an intake passage defined in part by an intake front wall, said outlet mouth communicating with an outlet passage in a blower casing, said blower casing being defined in part by a front blower casing wall spaced inboard from said intake front wall and having an air inlet therethrough for admitting air from said intake passage to said blower casing, a centrifugal scroll caged blower mounted in said blower casing between said intake mouth and said outlet mouth, said centrifugal blower having a blower wheel axially thin with respect to its diameter, mounted on a blower wheel shaft with an axis of rotation substantially perpendicular to a long dimension of said outlet mouth, and electric motor means connected to said shaft for rotating said centrifugal blower wheel, baffle means in said inlet passage, outside said blower casing, for directing air in separate paths through said intake to said air inlet of said front blower casing wall and outlet divider and guide wing means in said blower casing between said blower wheel and said outlet mouth and extending transversely of said outlet mouth for dividing the flow of and spreading air discharged from said blower along the long dimension of said outlet mouth.

2. In a blower assembly by which air is drawn over coils through a thin, wide coil passage containing said coils, said coil passage being defined by generally parallel, wide coil passage from and back walls and relatively narrow side walls, the improvement comprising a blower housing having an intake passage having an open intake mouth communicating with said coil passage, said intake passage being defined by inner surfaces of an intake front wall, an intake back wall and an arched intake side wall connecting said blower housing intake front and back walls; a blower casing having a casing back wall projecting above said intake back wall, a casing front wall that is substantially parallel to the intake front wall and spaced inwardly therefrom, and a casing volute side wall bridging between said casing front and back walls, said casing front, back and volute side wall defining an outlet passage and three sides of a generally rectangular outlet mouth; a centrifugal blower wheel, axially thin relative to its diameter, mounted in said blower casing between said casing front and back walls on a blower wheel shaft oriented substantially perpendicularly to said casing front wall, said casing front wall having an air inlet opening through it substantially concentric with said blower wheel shaft and within the compass of said arched intake side wall, said blower casing volute wall having a first part closely spaced from said centrifugal blower wheel at a point above and between said centrifugal blower wheel and said outlet mouth, said volute side wall extending from said first part around said centrifugal blower wheel, beneath said centrifugal blower wheel and up the side opposite said first part toward said outlet mouth, spaced progressively farther from said centrifugal blower wheel from said first part, around said centrifugal blower wheel toward said outlet mouth; an electric motor connected to rotate said blower wheel shaft; and a heart-shaped intake baffle symmetrically arranged with respect to said blower inlet, spanning between said intake passage front and back walls, said heart-shaped intake baffle having a concave arc part below and along an edge of said blower inlet opening and a narrow part toward said intake mouth.

3. The system of claim 2 including guide wing means and divider means in said outlet passage, said guide wing and divider means being positioned between said centrifugal blower wheel and said outlet mouth and bridging between front and back blower casing walls for dividing the flow of and distributing air from said centrifugal blower wheel over a wide duct.

4. The system of claim 2 wherein an inner end of said guide wing means extends to the end of said volute wall nearest the centrifugal blower wheel, and, with a double curve, extends to said outlet passage mouth.

5. The system of claim 2 wherein the coils are evaporator coils.

6. The system of claim 2 wherein the electric motor is a brushless permanent magnet motor.

* * * * *